US010921104B1

(12) United States Patent
Pittman

(10) Patent No.: US 10,921,104 B1
(45) Date of Patent: Feb. 16, 2021

(54) ROTATION INHIBITED PROJECTILE TIP

(71) Applicant: Kyle Pittman, Seymour, TN (US)

(72) Inventor: Kyle Pittman, Seymour, TN (US)

( * ) Notice: Subject to any disclaimer, the term of this patent is extended or adjusted under 35 U.S.C. 154(b) by 0 days.

(21) Appl. No.: 16/665,564

(22) Filed: Oct. 28, 2019

(51) Int. Cl.
*F42B 12/02* (2006.01)
*F42B 12/06* (2006.01)

(52) U.S. Cl.
CPC ..... *F42B 12/06* (2013.01)

(58) Field of Classification Search
CPC ..... F42B 12/06; F42B 12/34; F42B 12/40; F42B 12/44; F42B 12/74; F42B 12/78; F42B 12/204; F42B 30/02
USPC ..... 102/501, 502, 513, 516–523, 529, 102/530–531
See application file for complete search history.

(56) References Cited

U.S. PATENT DOCUMENTS 2,452,072 A * 10/1948 Schatz ..... F42C 1/02 102/481
3,013,495 A * 12/1961 Stevenson ..... F42B 12/38 102/513
4,136,616 A * 1/1979 Schirneker ..... F42B 12/34 102/510
4,625,650 A * 12/1986 Bilsbury ..... F42B 12/204 102/364
4,655,140 A * 4/1987 Schirneker ..... F42B 10/22 102/508
4,870,884 A * 10/1989 Schubart ..... F42B 12/24 86/20.12
4,913,054 A * 4/1990 Petersen ..... F42B 12/34 102/439
5,025,730 A * 6/1991 Petrovich ..... F42B 12/78 102/501
5,038,684 A * 8/1991 Petrovich ..... F42B 12/78 102/515
5,069,139 A * 12/1991 Denis ..... F42B 12/78 102/518
5,105,744 A * 4/1992 Petrovich ..... F42B 12/78 102/515
5,174,384 A * 12/1992 Herman ..... A62C 31/00 102/504
5,297,492 A * 3/1994 Buc ..... F42B 14/061 102/513
5,686,693 A * 11/1997 Jakobsson ..... F42B 12/72 102/501
6,024,021 A * 2/2000 Schultz ..... F42B 12/74 102/506
6,305,293 B1 * 10/2001 Fry ..... F42B 12/78 102/516

(Continued)

*Primary Examiner* — Michael D David
(74) *Attorney, Agent, or Firm* — Knox Patents; Thomas A. Kulaga

(57) ABSTRACT

Apparatus for inhibiting rotation of a projectile tip relative to a longitudinal axis of the projectile. The projectile includes a tip and a jacket with a core. The tip includes a stem that protrudes into said core. The stem includes a plurality of grooves that engage the core. At least one transverse groove inhibits linear motion of the tip along a longitudinal axis of the projectile. At least one longitudinal groove extending along a portion of the length of the tip stem inhibits rotation about the longitudinal axis. In one embodiment, three longitudinal grooves have a spiral shape with the grooves equally spaced about the circumference of the tip stem. In another embodiment, two sets of longitudinal grooves spiral in opposite directions around the tip stem.

20 Claims, 5 Drawing Sheets

(56) References Cited

U.S. PATENT DOCUMENTS 6,543,365 B1 * 4/2003 Vasel ..... F41B 11/57 102/502
6,581,522 B1 * 6/2003 Julien ..... F42B 5/192 102/430
6,613,165 B1 * 9/2003 Alexander ..... B32B 15/01 102/516
6,659,013 B1 * 12/2003 Kellner ..... F42B 12/06 102/516
6,973,879 B1 * 12/2005 McElroy ..... F42B 12/74 102/501
7,059,233 B2 * 6/2006 Amick ..... A01K 95/005 102/517
8,915,191 B2 * 12/2014 Jones ..... F42B 12/54 102/502
2003/0047105 A1 * 3/2003 Vasel ..... F42B 6/10 102/502
2003/0127014 A1 * 7/2003 O'Dywer ..... F42B 5/035 102/523
2004/0244629 A1 * 12/2004 Jopson ..... F42B 12/367 102/508
2005/0126422 A1 * 6/2005 Lamm ..... F42B 8/12 102/518
2005/0183617 A1 * 8/2005 MacDougall ..... F42B 12/78 102/514
2005/0188886 A1 * 9/2005 Vasel ..... F42B 6/10 102/502
2008/0092768 A1 * 4/2008 Krstic ..... F42B 12/74 102/522
2011/0107937 A1 * 5/2011 Thompson ..... F42B 12/78 102/517
2013/0014667 A1 * 1/2013 Mutascio ..... F42B 12/38 102/513
2014/0130699 A1 * 5/2014 Peterson ..... F41C 7/00 102/520
2014/0318402 A1 * 10/2014 Carlson ..... F42B 12/76 102/439
2015/0268019 A1 * 9/2015 Amick ..... F42B 12/78 102/439
2016/0091289 A1 * 3/2016 Peterson ..... F42B 5/02 102/501

* cited by examiner

ROTATION INHIBITED PROJECTILE TIP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

1. Field of Invention

This invention pertains to a tip for a cup-and-core type projectile. More particularly, this invention pertains to a cup-and-core type projectile with a tip having a stem that is firmly fixed to the core.

2. Description of the Related Art

Firearm projectiles, or bullets, have various constructions. One common type of projectile has a cup-and-core type construction. Another common type of projectile has a bonded construction where the core and jacket are fused together, typically using a high temperature process. Yet another type of projectile has a mono-metal (monolithic) construction where the body of the projectile is extruded or machined from a single slug of metal.

A standard cup-and-core type projectile has a core inside a jacket. The core is a dense metal, such as lead, with the jacket being a metal, such as copper or other ductile material. The jacket surrounds the core, forming an outer surface. Generally, the jacket has a cylindrical portion that is a bearing surface with a specific diameter corresponding to the caliber of the firearm in which the projectile is to be used.

Many such projectiles include a tip that projects from the forward end of the jacket. The tip has a stem embedded in the core. The stem secures the tip to the core. It is desirable for the tip to be firmly secured in the projectile to ensure tip stability, improve aesthetics, and increase in-flight performance of the projectile, which increases the accuracy of the projectile during use.

A common fabrication method for cup-and-core projectiles is to swage the jacket over the core with high pressure to produce the desired shape and configuration of the projectile. Swaging allows for consistency during manufacturing, with little variation between individual projectiles. Swaging cup-and-core type projectiles is a multi-step process. The last steps often include cleaning and polishing the projectiles, often by tumbling the projectiles with another material. Such cleaning and polishing has a tendency to stress the projectile. If the tip is not properly secured, the tip can loosen from the core.

BRIEF SUMMARY

According to one embodiment of the present invention, a projectile tip that inhibits rotation around the projectile's rotational axis relative to the rest of the projectile is provided. The projectile is a cup-and-core type with a tip. The tip has a stem with a rotation inhibitor that engages the core. The rotation inhibitor includes grooves or channels that extend longitudinally along a portion of the length of the stem. The rotation inhibitor is positioned to inhibit the tip from being moving relative to the cup-and-core portion of the projectile. The rotation inhibitor is also positioned to ensure dynamic balance of the projectile during ballistic flight.

The stem also includes one or more horizontal or transverse grooves that encircle the stem. The transverse grooves inhibit linear motion along the longitudinal axis of the projectile relative to the rest of the projectile.

The rotation inhibitor, in one embodiment, includes longitudinal grooves that inhibit rotational motion around the longitudinal axis of the projectile relative to the core and the jacket. In one embodiment, there are three, equally spaced longitudinal grooves that extend along a portion of the length of the stem. In one such embodiment, the longitudinal grooves spiral around a portion of the stem. For example, with three spiral grooves, each groove is spaced apart from the others by 120 degrees around the circumference of the stem. Each spiral groove extends for 120 degrees around the circumference of the stem. In this way, there is a portion of a spiral groove that is positioned around the full circumference of the stem, thereby ensuring that the projectile is fully balanced around its rotational axis, which coincides with the projectile's longitudinal axis. In another embodiment, two sets of longitudinal grooves spiral around a portion of the stem. The two sets of grooves spiral in different directions, for example, one direction is a left-handed spiral and the other direction is a right-handed spiral. In one such embodiment, the grooves of each set intersect the other set as they spiral around the stem.

In various embodiments, the various grooves have a V-shaped profile and/or a rectangular profile. In each embodiment, the grooves are sized and dimensioned to receive a portion of the core when the projectile is swaged during fabrication. In this way the stem is held in a fixed position relative to the core after swaging. The tip is then less likely to loosen and rotate relative to the rest of the projectile during the fabrication process after swaging. Such fabrication process often includes tumbling and polishing. The tip is also less likely to loosen and rotate relative to the rest of the projectile during shipping and handling and use.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for a rotation inhibited projectile tip 102 is disclosed. Various components and/or elements are illustrated and discussed both generically and specifically in the figures and in the following description. For example, the tip 102-A, 102-B, 102-C, 102-D is discussed individually and separately to ensure clarity when describing the configuration of each embodiment of the tip 102-A, 102-B, 102-C, 102-D. The tip 102, when referred to collectively, is referenced without the alphanumeric suffix.

Figure 1:
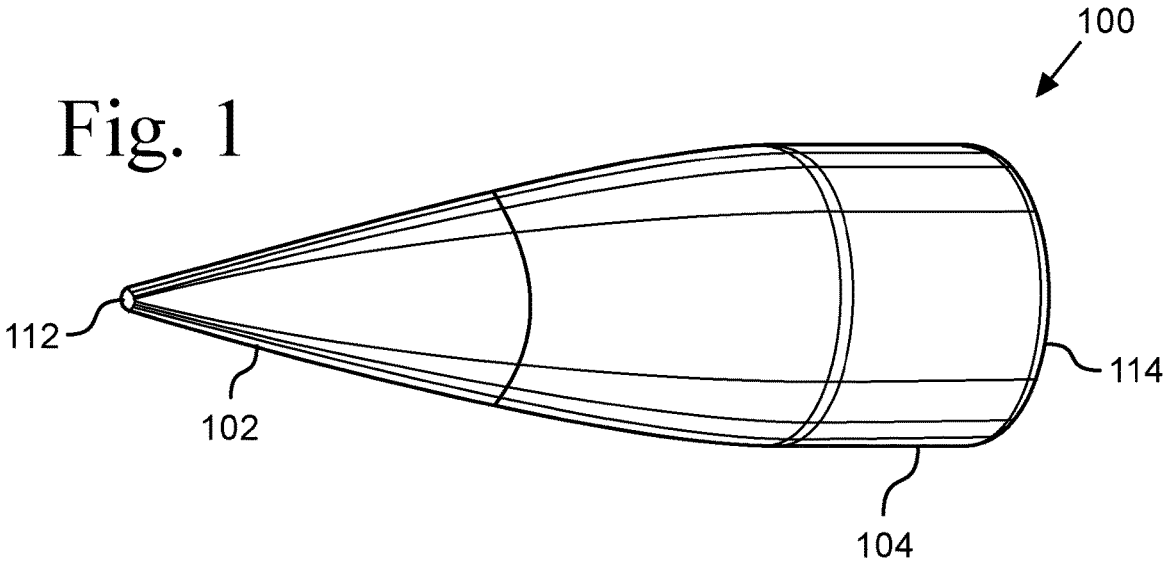
FIG. 1 is a perspective view of a projectile.

FIG. 1 illustrates a perspective view of a projectile 100. The projectile 100 is a cup-and-core type of projectile. The projectile 100 has a tip 102 and a jacket 104. The tip 102 has a point 112. The jacket 104 extends from the tip 102 to a base 114.

The point 112 is at the forward or front end of the projectile 100. The point 112 is a tapered end of the projectile 100 opposite the base 114. In the illustrated embodiment, the point 112 is rounded and has a small diameter radius. The base 114 in the illustrated embodiment is a flat surface that is perpendicular to the cylindrical surface of the jacket 104 adjacent the base 114. In other embodiments, the base 114 is cupped or has another, non-planar shape.

Figure 2:
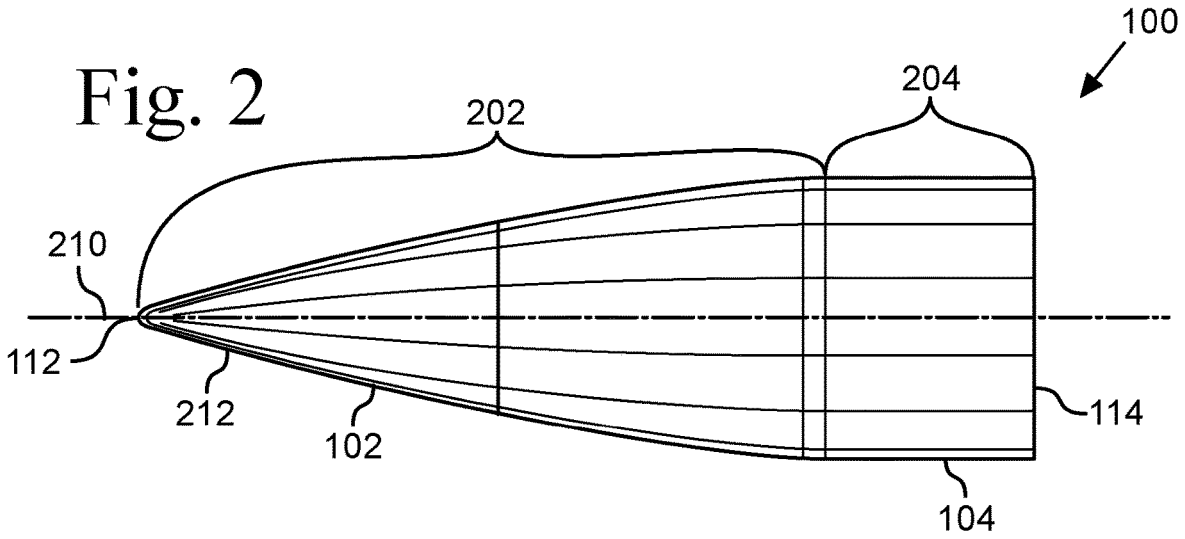
FIG. 2 is a side view of one embodiment of the projectile shown in FIG. 1.
Figure 3:
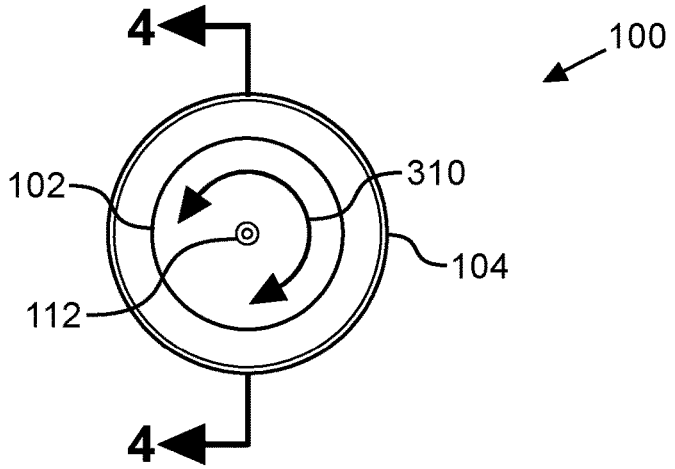
FIG. 3 is a top view of the embodiment of the projectile shown in FIG. 1.

FIG. 2 illustrates a side view of one embodiment of the projectile 100 shown in FIG. 1. FIG. 3 illustrates a top view of the embodiment of the projectile 100 shown in FIG. 1. The front portion of the projectile 100 is the nose 202. The rear or base portion of the projectile 100 is a bearing surface 204. Those skilled in the art will recognize that the size and configuration of the nose 202 relative to the bearing surface 204 can vary without departing from the spirit and scope of the present invention.

The nose 202 has a generally conical shape that extends from the bearing surface 204 to the point 112. The nose 202 includes the exposed portion, or the cone, 212 of the tip 102 and the forward portion of the jacket 104. Those skilled in the art will recognize that the configuration of the nose 202 can vary without departing from the spirit and scope of the present invention. For example, in other embodiments, the cone 212 of the tip 102 has other configurations, such as a cup or hollow forward section or a flattened point 112 instead of the illustrated rounded point 112. In various embodiments, the size of the cone 212 of the tip 102 relative to the jacket 104 varies such that either more or less of the tip 102 is exposed at the end of the jacket 104.

The bearing surface 204 is the rear portion of the jacket 104. The bearing surface 204 is cylindrical with a diameter that corresponds to the caliber of the firearm. In the illustrated embodiment, the bearing surface 204 is a regular cylinder with a constant diameter. In other embodiments, the bearing surface 204 is terminated with a boat tail adjacent the base 114.

The projectile 100 has a longitudinal axis 210 that extends through the point 112 and the center of the base 114. The longitudinal axis 210 is the rotational axis 210 of the projectile 100. The longitudinal axis 210 is also the rotational axis 210 of the tip 102. That is, the longitudinal axis 210 is coaxial with the rotational axis of the projectile 100 and the tip 102. The longitudinal axis 210 of the projectile 100 is coaxial with the central axis of the cylindrical bearing surface 204.

The longitudinal axis 210 is also coaxial with the center axis of the bore of the firearm barrel during internal ballistics. The direction of rotation 310 of the projectile during ballistic flight is determined by the direction of the rifling in the bore. It is not unusual for projectiles 100 to rotate about the rotational axis 210 at around 100,000 RPM. At such rotational speeds it is important to maintain balance within the projectile.

In the illustrated embodiment, the base 114 is planar and perpendicular to the longitudinal axis 210. Those skilled in the art will recognize that the configuration of the base 114 can vary, such as by being concave or cupped, without departing from the spirit and scope of the present invention.

Figure 4:
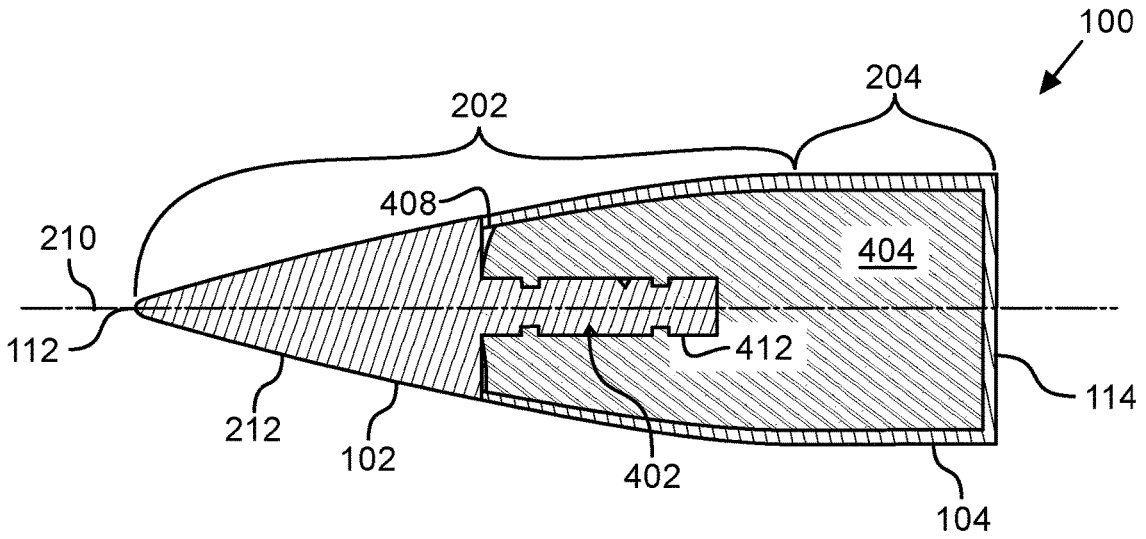
FIG. 4 is a cross-sectional view of one embodiment of the projectile.
Figure 5:
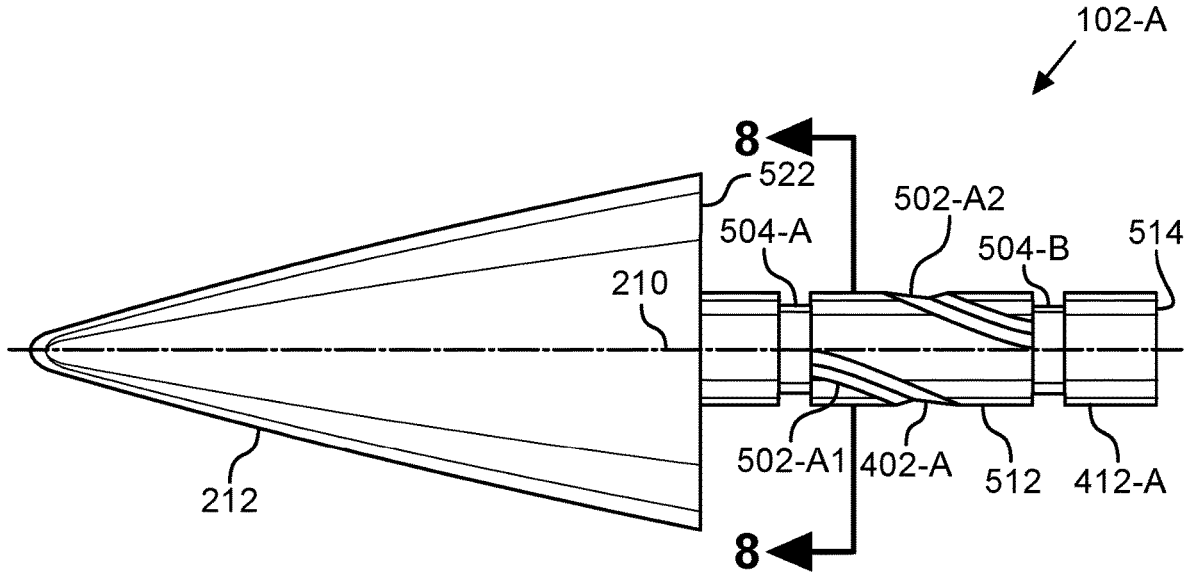
FIG. 5 is a side view of one embodiment of a tip.

FIG. 4 illustrates a cross-sectional view of one embodiment of the projectile 100-A. The projectile 100-A includes a jacket 104, a core 404, and one embodiment of the tip 102-A. FIG. 5 illustrates a side view of one embodiment of a tip 102-A. The tip 102-A includes a cone 212 and a stem 412-A.

The core 404 fills the inside of the jacket 104. For the most accuracy, it is advantageous to minimize or avoid voids 408 between the core 404 and the jacket 104 and tip 102. A common method of fabricating cup-and-core projectiles 100 is to swage them. Swaging is a process of applying pressure to form the jacket 104 and core 404 to a desired size and configuration.

The tip 102 includes a cone 212 and a stem 412 extending from a rear surface 522 of the cone 212. The tip 102 has the point 112 at the forward end with the stem 412 extending from the opposite end into the core 404. The stem 412 is an elongated member with a proximal end extending from the rear surface 522 of the cone 212 to the distal end 514.

The stem 412 has a cylindrical surface 512 and a distal end 514 that is away from the rear surface 522. The stem 412 includes a rotation inhibitor 402. The rotation inhibitor 402 interacts with the core 404 to minimize or inhibit rotation of the stem 412, and the tip 102, around the longitudinal axis 210 relative to the core 404. That is, the rotation inhibitor 402 locks the tip 102 into a fixed relationship with the core 404. The rotation inhibitor 402 also locks the tip 102 into a fixed relationship with the jacket 104 because the core 404 is fixed to the jacket 104.

In the embodiment of the tip 102-A illustrated in FIG. 5, the rotation inhibitor 402-A of the stem 412-A includes spiral grooves 502-A1, 502-A2 that are equally spaced around the circumference of the stem 412-A. The stem 412-A also includes a pair of transverse grooves 504-A, 504-B. The spiral grooves 502-A1, 502-A2 are equally spaced around the circumference of the stem 412-A. The spiral grooves 502-A1, 502-A2 extend between the pair of transverse grooves 502.

Figure 8:
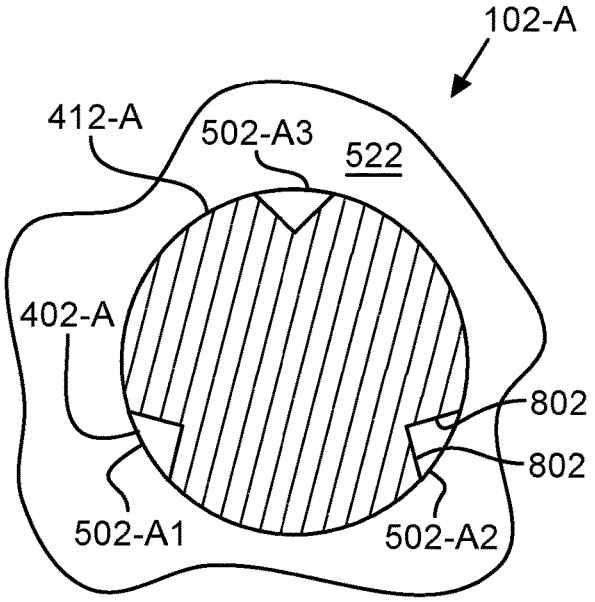
FIG. 8 is a partial cross-sectional view of the embodiment of the tip shown in FIG. 5.

The illustrated spiral grooves 502-A1, 502-A2 have a V-shape, which is further illustrated in FIG. 8. In the illustrated embodiment, there are three spiral grooves 502 that are evenly spaced apart around the circumference of the stem 412-A. That is, the three spiral grooves 502 are positioned 120 degrees from each other. The illustrated spiral grooves 502 wrap around the circumference of the stem 412-A for 120 degrees. The even spacing of the grooves 502 ensures that the tip 102 does not introduce any imbalance around the longitudinal axis 210.

In the illustrated embodiment, the spiral grooves 502-A1, 502-A2 are bounded on each end by the transverse grooves 504-A, 504-B. In another embodiment, the spiral grooves 502-A1, 502-A2 are bounded on one end by only one of the transverse grooves 504-A, 504-B. In yet another embodiment, the spiral grooves 502-A1, 502-A2 are not bounded on either end by the transverse grooves 504-A, 504-B. Instead, the spiral grooves 502-A1, 502-A2 themselves, by their nature of spiraling around the stem 412-A, inhibit both linear movement along the longitudinal axis 210 and inhibit rotational movement 310 about the longitudinal axis 210.

During swaging, the core 404 flows around the stem 412 and engages the various grooves 502, 504. The core 404 and the jacket 104 are also secured together through the swaging process. In this way, the components of the projectile 100, namely, the tip 102, the core 404, and the jacket 104, are firmly held together during the remainder of the manufacturing and fabrication process and during shipping and handling of the fabricated projectile 100.

After swaging, the transverse grooves 504-A, 504-B are engaged by the core 404 and inhibit linear motion between the tip 102 and the core 404 along the longitudinal axis 210. Swaging causes the material of the core 404 to flow into the transverse grooves 504-A, 504-B.

After swaging, the spiral grooves 502-A1, 501-A2 are engaged by the core 404 and inhibit rotational motion between the tip 102 and the core 404 around the longitudinal axis 210. In one embodiment, the spiral grooves 502-A1, 501-A2 have a spiral that matches the rifling in the bore of the barrel. In this way, the force imparted upon the projectile 100 by the rifling has a tendency to tighten the tip 102-A in the core 404.

Figure 6:
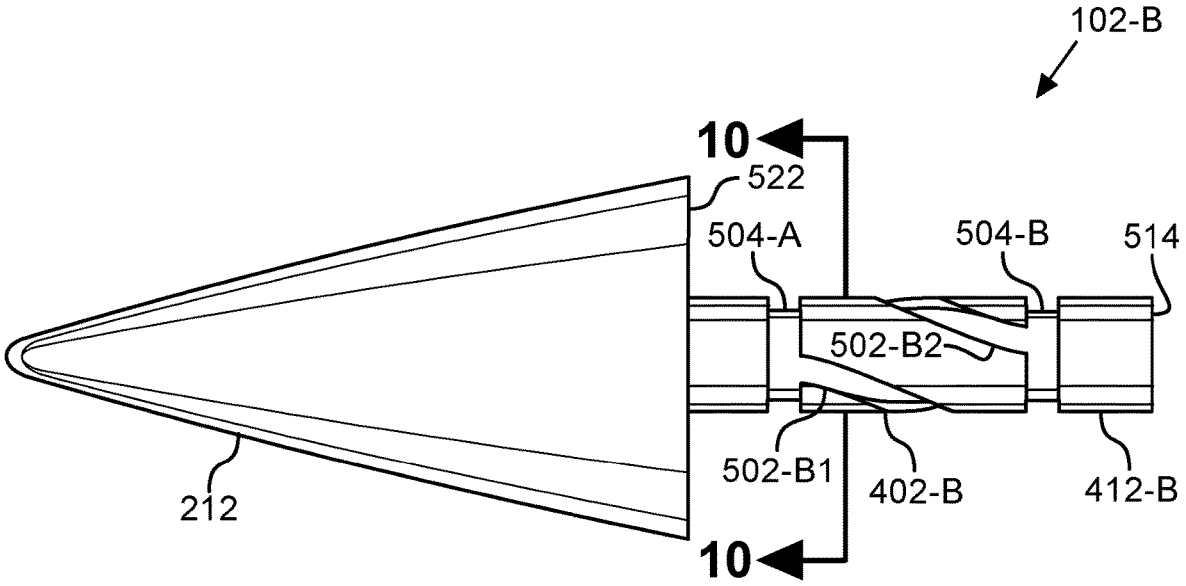
FIG. 6 is a side view of another embodiment of a tip.

FIG. 6 illustrates a side view of another embodiment of a tip 102-B that is similar to the embodiment illustrated in FIG. 5, except that the configuration of the spiral grooves 502-B1, 502-B2 is different. The configuration of the spiral grooves 502-B1, 502-B2 is illustrated in the cross-sectional view shown in FIG. 10.

In the embodiment of the tip 102-B illustrated in FIG. 6, the rotation inhibitor 402-B of the stem 412-B includes spiral grooves 502-B1, 502-B1 that are equally spaced around the circumference of the stem 412-A. The spiral grooves 502-B1, 501-B2 shown in FIG. 6 are squared-off, U-shaped channels with a pair of sidewalls formed in the stem 412-B with a bottom joining the sidewalls, whereas, the spiral grooves 502-A1, 501-A2 shown in FIG. 5 are V-shaped channels, that is, there are two sidewalls that are joined in the center.

Figure 7:
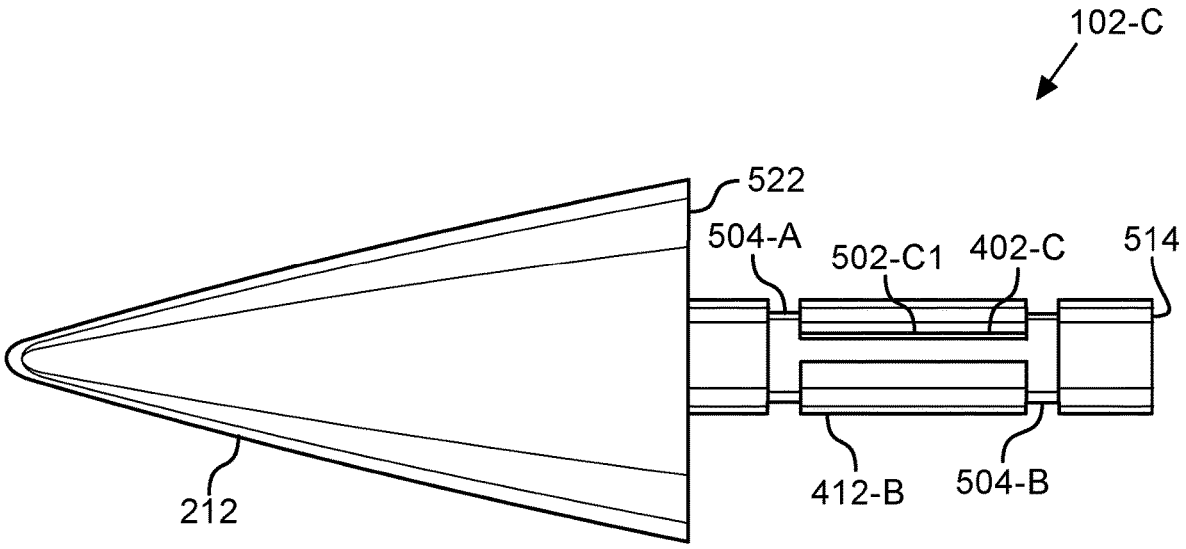
FIG. 7 is a side view of yet another embodiment of a tip.

FIG. 7 illustrates a side view of yet another embodiment of a tip 102-C. In the embodiment of the tip 102-C illustrated in FIG. 7, the rotation inhibitor 402-C of the stem 412-C includes longitudinal grooves 502-C1 that are parallel to the longitudinal axis 210. In the illustrated embodiment, the longitudinal grooves 502-C1 have parallel sidewalls 802'. In other embodiments, the grooves 502-C1 have a different configuration, such as a V-shape similar to the grooves 502-A shown in FIG. 5 or three-sided grooves with non-parallel sidewalls.

The longitudinal grooves 502-C1 are equally spaced around the circumference of the stem 412-C. In the illustrated embodiment, the grooves 502-C1 extend between the pair of transverse grooves 504-A, 504-B. For example, with three grooves 502-C1, the grooves 502-C1 are positioned every 120 degrees around the circumference of the stem 412-C.

In the illustrated embodiment, the longitudinal grooves 502-C1 are bounded on each end by the transverse grooves 504-A, 504-B. In another embodiment, the longitudinal grooves 502-C1 are bounded on one end by only one of the transverse grooves 504-A, 504-B.

FIG. 8 illustrates a partial cross-sectional view of the embodiment of the tip 102-A shown in FIG. 5. The illustrated rotation inhibitor 402-A includes the spiral grooves 502-A1, 501-A2, 502-A3. Each of the spiral grooves 502-A1, 501-A2, 502-A3 is a V-shaped groove or channel with two sidewalls 802 that meet in the center.

In one embodiment, the tip 102-A is machined with the spiral grooves 502-A1, 501-A2, 502-A3 machined in the stem 412-A and the cylindrical surface of the stem 412-A machined to be smooth after the spiral grooves 502-A1, 501-A2, 502-A3 are machined.

Figure 9:
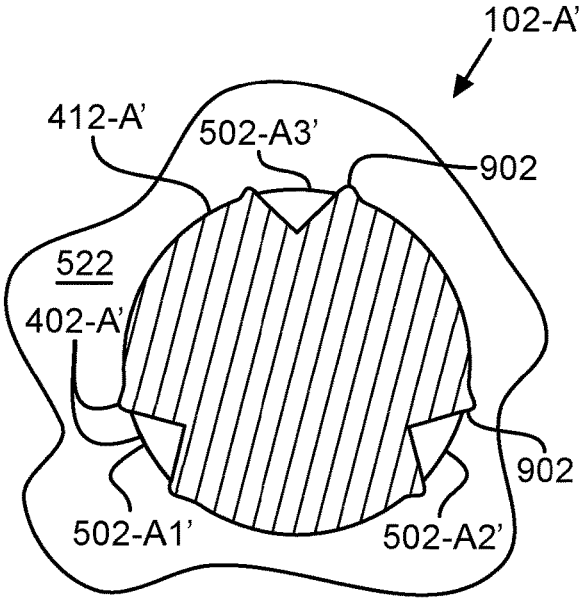
FIG. 9 is a partial cross-sectional view of another embodiment of the tip shown in FIG. 5.

FIG. 9 illustrates a partial cross-sectional view of another embodiment of the tip 102-A' shown in FIG. 5. The illustrated rotation inhibitor 402-A' includes spiral grooves 502-A1', 501-A2', 502-A3' and the protrusions or ridges 902 at the edges of the grooves 502-A1', 501-A2', 502-A3'.

Each of the spiral grooves 502-A1', 501-A2', 502-A3' is a V-shaped groove or channel with two sidewalls 802 that meet in the center. The edges 902 of the stem 412-A' adjacent the edges of the spiral grooves 502-A1', 501-A2', 502-A3' are raised. The raised edges 902 are an artifact of the method used to form the spiral grooves 502-A1', 501-A2', 502-A3' in the stem 412-A'. In such an embodiment, the stem 412-A' is not machined to smooth the cylindrical surface 512 after the spiral grooves 502-A1', 501-A2', 502-A3' are formed.

Figure 10:
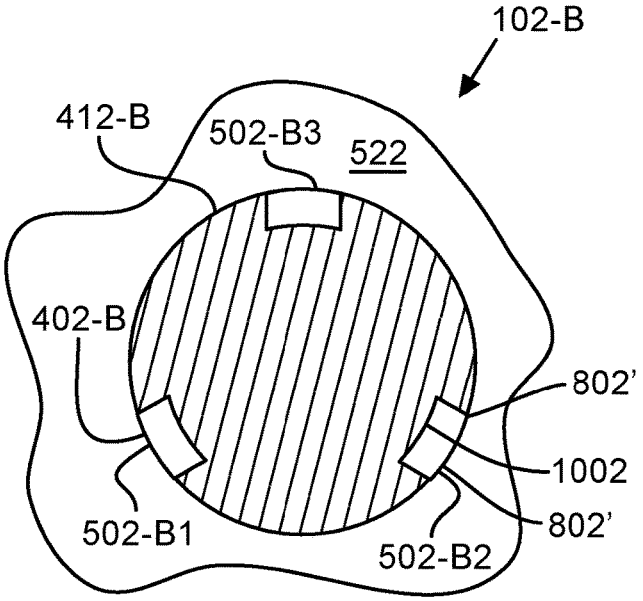
FIG. 10 is a partial cross-sectional view of the embodiment of the tip shown in FIG. 6.

FIG. 10 illustrates a partial cross-sectional view of the embodiments of the tip 102-B, 102-C shown in FIG. 6. The illustrated rotation inhibitor 402-B includes the grooves 502-B1, 501-B2, 502-B3 in the stem 412-B. Each of the spiral grooves 502-B1, 501-B2, 502-B3 is a rectangular-shaped groove or channel with two sidewalls 802' with a bottom 1002 joining the two sidewalls 802'.

With respect to the tip 102-C shown in FIG. 7, the cross-sectional view of the three grooves 502-C1 is substantially as shown in FIG. 10 except that the illustrated distance between the pair of sidewalls 802' will be less than as illustrated.

In the illustrated embodiment, the sidewalls 802' are substantially parallel. In another embodiment, the sidewalls 802' are not parallel. In either embodiment, the grooves 502-B1, 501-B2, 502-B3 receive the core 404 during swaging, thereby locking the tip 102-C in position relative to the core 404 and the jacket 104.

Figure 11:
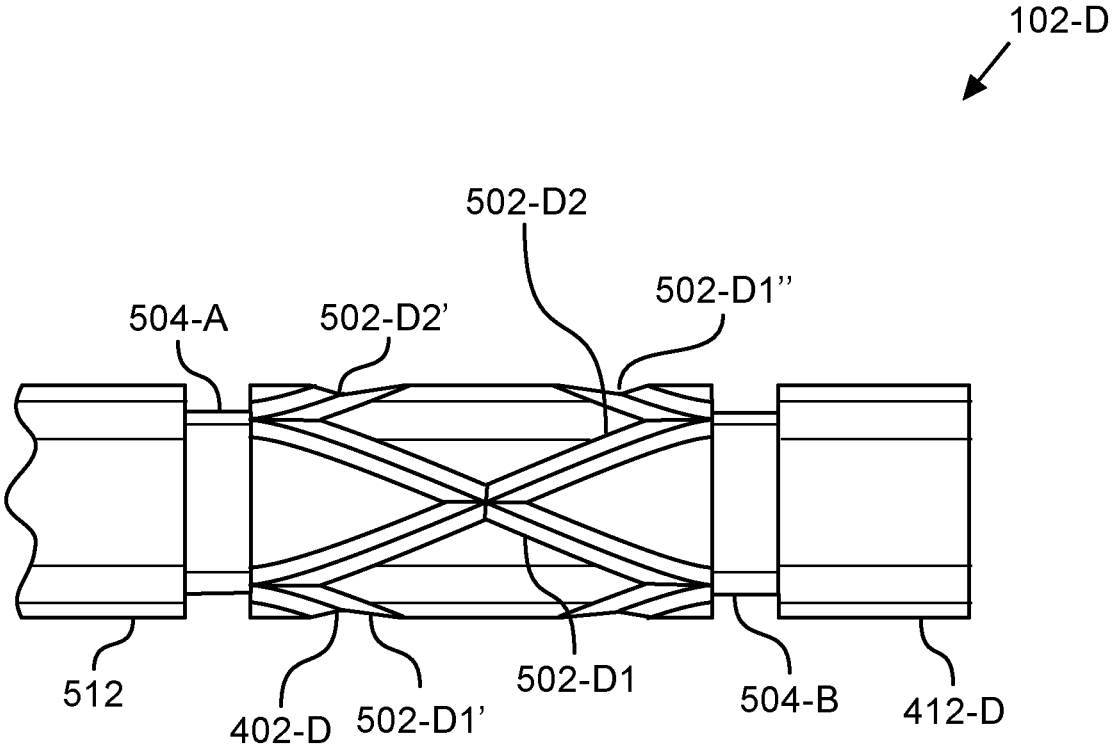
FIG. 11 is a partial side view of another embodiment of a tip showing the stem.

FIG. 11 illustrates a partial side view of another embodiment of a tip 102-D showing another embodiment of the stem 412-D. In the embodiment of the tip 102-D illustrated in FIG. 11, the rotation inhibitor 402-D of the stem 412-D includes two sets of spiral grooves 502-D1, 502-D1', 502-D1", 502-D2, 502-D2' where each set 502-D1, 501-D2 spirals in an opposite direction on the surface 512 of the stem 412-D.

The first set of spiral grooves 502-D1, 502-D1', 502-D1" are similar to the grooves 502-A shown in FIG. 5, that is, the grooves 502-D1, 502-D1', 502-D1" spiral in one direction with each one of the spiral grooves 502-D1, 502-D1', 502-D1" extending 120 degrees around the circumference of the stem 412-D. Each one of the spiral grooves 502-D1, 502-D1', 502-D1" are spaced from the adjacent one of the grooves 502-D1, 502-D1', 502-D1" by 120 degrees such that three of the spiral grooves 502-D1, 502-D1', 502-D1" are equally spaced around the circumference of the stem 412-D.

The second set of spiral grooves 502-D2 spiral in the opposite direction relative to the first set of grooves 502-D1. The second set of spiral grooves 502-D2, 501-D2' extend around the stem 412-D and have the same spacing as the first set 502-D1 of grooves. The two sets of grooves 502-D1, 501-D2 intersect at the transverse grooves 504-A, 504-B and at the midpoint between the transverse grooves 504-A, 504-B.

In the illustrated embodiment, each set of grooves 502-D1, 501-D2 includes three equally spaced spiral grooves 502-D1, 502-D1', 502-D2, 502-D2' that have a V-Shape into the stem 412-D. In other embodiments, the grooves 502-D1, 502-D l', 502-D2, 502-D2' each have three surfaces, such as illustrated in FIG. 10. In such an embodiment, the opposing surfaces 802' are either parallel or at an angle. In another embodiment, the number of grooves 502-D in each set 502-D1, 501-D2 is greater than illustrated, such as a knurl. A cut knurl typically produces channels 502-A such as illustrated in FIG. 8. A form or rolled knurl typically produces edges 902 such as illustrated in FIG. 9.

FIGS. 5 to 11 illustrate various embodiments of the rotation inhibitor 402 on the stem 412. In the embodiments of the tip 102-A, 102-B, 102-C, 102-D the rotation inhibitor 402-A, 402-B, 402-C, 402-D includes the grooves 502-A, 502-B, 502-C, 502-D. Further, for the embodiment of the tip 102-A', the rotation inhibitor 402-A' includes the protrusions 902 extending from the stem 412-A'. Accordingly, the rotation inhibitor 402 include grooves or channels 502 in the stem 412 and/or protrusions 902 extending away from the stem 412.

In various embodiments, the rotation inhibitor 402 includes one or more grooves 502 extending longitudinally between the tip's rear surface 522 and the distal end 514 of the stem 412. In one such embodiment, a single groove 502 spirals around the circumference 512 of the stem 412 with one end of the groove 502 proximate the tip rear surface 522 and the other end proximate the distal end 514 of the stem 412. In other embodiments, multiple grooves 502 are disposed around the circumference 512 of the stem 412 with one end of each groove 502 proximate the tip surface 522 and the other end proximate the end 514 of the stem 412, and each groove 502 is spaced at regular intervals around the circumference 512 such that dynamic balance of the projectile 100 is maintained. In various embodiments, the rotation inhibitor 402 includes ridges, fins, or other protrusions 902 that interact with the core 404 to secure the tip 102 with the rest of the projectile 100. In one such embodiment, the rotation inhibitor 402-D includes counter-spiraling grooves 502-D, for example, regularly spaced channels or a knurl.

In one embodiment, the rotation inhibitor 402 includes one or more grooves 502 extending longitudinally between the surface 522 and the end 514 of said stem 412 with the ends of the grooves 502 bounded by the transverse grooves 504. In another embodiment, the grooves 502 extend from one transverse groove 504-A proximate the tip surface 522 to the distal end 514 of the stem 412.

The rotation inhibitor 404 is disposed around the circumference 512 of the stem 412 in such a manner that the tip 102 and the projectile 100 is dynamically balanced about the axis of rotation 210. That is, the rotation inhibitor 404 is disposed around the circumference 512 of the stem 412 such that the mass of the stem 412 and the surrounding core 404 is evenly distributed around the rotational axis 210. Dynamic balance is the condition where the longitudinal axis 210 and the rotational axis 210 of the projectile are coaxial during flight of the projectile 100.

The tip 102 includes various functions. The function of inhibiting linear movement along the longitudinal axis 210 is implemented, in one embodiment, by the transverse, or horizontal, grooves 504-A, 504-B. In various embodiments, there are one or more transverse grooves 504-A, 504-B.

The function of inhibiting rotational movement around the longitudinal axis 210 is implemented, in one embodiment, by the spiral grooves 502-A, 501-A', 502-B along the stem 412-A, 412-A', 412-B of the tip 102-A, 102-A', 100-B.

The function of balancing the tip 102 around the longitudinal axis 210 is implemented, in one embodiment, by spacing the grooves 502 evenly around the circumference of the stem 412. On one such embodiment, three spiral grooves 502-A, 501-A', 502-B ensure that there is no unevenly spaced concentrations of weight around the longitudinal axis 210, which is the axis of rotation as the projectile 100 moves during ballistic flight.

From the foregoing description, it will be recognized by those skilled in the art that a projectile tip 102 that inhibits rotation relative to the body of the projectile 100 has been provided. The tip 102 includes a cone 212 and a stem 412. The stem 412 includes a plurality of grooves 502, 504 that engage the core of the cup-and-core projectile to inhibit relative motion, both rotational and linear, between the tip 102 and the core 404 and jacket 104.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus configured for inhibiting relative rotation of projectile components, said apparatus comprising:
   - a jacket defining at least a portion of an external surface of a projectile, said jacket defining a bearing surface proximate a first end;
   - a core disposed inside said jacket;
   - a tip proximate a second end of said jacket, said tip having a stem protruding from a surface of said tip, said stem being an elongated member having a circumference, a portion of said stem disposed inside said core; and
   - a rotation inhibitor disposed on a surface of said stem, said rotation inhibitor including a plurality of first grooves, said plurality of first grooves spaced apart equally around said circumference of said stem; said rotation inhibitor engaging said core inside said jacket whereby said stem is inhibited from rotating about a longitudinal axis of said stem where such rotation of said stem is relative to said core.

2. The apparatus of claim 1 further including at least one transverse groove proximate a distal end of said stem, wherein said at least one transverse groove engages said core to inhibit linear movement of said stem along said longitudinal axis where such linear movement of said stem is relative to said core.

3. The apparatus of claim 1 wherein said plurality of first grooves includes three channels extending partially along a length of said stem.

4. The apparatus of claim 1 wherein said rotation inhibitor further includes a plurality of second grooves, said plurality of first grooves spiraling around a portion of said stem in a first direction, and said plurality of second grooves spiraling around said portion of said stem in a second direction.

5. The apparatus of claim 3 wherein each one of said three channels is defined by a spiral extending 120 degrees around said circumference of said stem.

6. The apparatus of claim 3 wherein said plurality of first grooves each have a V-shape configuration.

7. The apparatus of claim 3 wherein said three channels are parallel to said longitudinal axis.

8. The apparatus of claim 1 wherein said tip includes a cone having a point and said surface, said point being at an opposite end of said tip relative to a distal end of said stem, and said cone extending from said second end of said jacket.

9. An apparatus configured for inhibiting rotation of a tip for a projectile about a rotational axis of the projectile, the projectile being a cup-and-core type having a core surrounded by a jacket, said apparatus comprising:

a stem extending from a surface, said stem having a longitudinal axis coaxial to the rotational axis of the projectile, the tip including said stem and said surface; and a rotation inhibitor including three first grooves extending longitudinally between a proximal end and a distal end of said stem, whereby said three first grooves engage the core inside the jacket to inhibit rotation of said stem relative to the core.

10. The apparatus of claim 9 wherein said three first grooves that are spaced equally around a circumference of said stem.

11. The apparatus of claim 10 wherein each one of said three first grooves spirals 120 degrees around said circumference of said stem.

12. The apparatus of claim 10 wherein said rotation inhibitor further includes three second grooves spaced equally around a circumference of said stem, wherein said three second grooves intersect said three first grooves.

13. The apparatus of claim 9 wherein said three first grooves are sized and dimensioned to receive a portion of said core after said projectile is swaged during fabrication of the projectile.

14. The apparatus of claim 9 wherein said three first grooves are parallel to said longitudinal axis.

15. The apparatus of claim 9 further including a transverse groove that encircles a circumference of said stem.

16. An apparatus configured for inhibiting rotation of a tip for a projectile about a rotational axis of the projectile, the projectile being a cup-and-core type having a core surrounded by a jacket, said apparatus comprising:

a stem being an elongated member extending from a surface, said stem having a longitudinal axis coaxial to the rotational axis of the projectile, the tip including said stem and said surface;

a body including the core surrounded by the jacket, said stem extending into said jacket, said stem surrounded by the core; and a rotation inhibitor disposed on a surface of said stem, said rotation inhibitor includes a plurality of grooves, said rotation inhibitor engaging said core inside said jacket whereby said stem is inhibited from rotating about a longitudinal axis of said stem where such rotation of said stem is relative to said core.

17. The apparatus of claim 16 wherein said plurality of grooves are spaced apart equally around said circumference of said stem such that dynamic balance is maintained during ballistic flight of the projectile.

18. The apparatus of claim 16 wherein said plurality of grooves includes three first grooves, and each one of said three first grooves spaced apart 120 degrees around a circumference of said stem, each one of said three first grooves extending longitudinally between a proximal end and a distal end of said stem.

19. The apparatus of claim 16 wherein said rotation inhibitor includes a plurality of protrusions extending away from said stem, and each one of said plurality of protrusions is evenly disposed around a circumference of said stem such that dynamic balance is maintained during ballistic flight of the projectile.

20. The apparatus of claim 16 further including at least one transverse groove proximate a distal end of said stem, wherein said at least one transverse groove engages the core to inhibit linear movement of said stem along the rotational axis where such linear movement of said stem is relative to the core.

* * * * *